US006387196B1

(12) United States Patent
Yamaguchi et al.

(10) Patent No.: US 6,387,196 B1
(45) Date of Patent: May 14, 2002

(54) PROCESS FOR PRODUCING PARTICLE-REINFORCED TITANIUM ALLOY

(75) Inventors: Toshiya Yamaguchi, Nishikamo-gun; Tadahiko Furuta; Takashi Saito, both of Aichi-gun; Kouji Sakurai, Yokkaichi, all of (JP)

(73) Assignees: Toyota Jidosha Kabushiki Kaisha, Toyota; Kabushiki Kaisha Chuo Kenkyusho, Aichi-gun; Aisan Kogyo Kabushiki Kaisha, Obu, all of (JP)

( * ) Notice: Subject to any disclaimer, the term of this patent is extended or adjusted under 35 U.S.C. 154(b) by 0 days.

(21) Appl. No.: 09/419,979

(22) Filed: Oct. 18, 1999

(30) Foreign Application Priority Data

Oct. 29, 1998 (JP) ..... 10-308921

(51) Int. Cl.[7] ..... C22C 14/00

(52) U.S. Cl. ..... 148/669; 419/12; 419/13; 419/14; 419/29; 148/514

(58) Field of Search ..... 148/669, 514, 148/421; 419/12, 13, 14, 29

(56) References Cited

U.S. PATENT DOCUMENTS 4,729,546 A * 3/1988 Allison ..... 251/368
4,852,531 A * 8/1989 Abkowitz et al. .... 123/188 AA
5,068,003 A * 11/1991 Takahashi et al. ..... 148/421
5,409,518 A 4/1995 Saito et al.
5,517,956 A * 5/1996 Jette et al. ..... 123/188.3

FOREIGN PATENT DOCUMENTS

| | | |
|---|---|---|
| JP | A-61-210164 | 9/1986 |
| JP | A-62-284051 | 12/1987 |
| JP | A-2-125849 | 5/1990 |
| JP | A-5-5138 | 1/1993 |

OTHER PUBLICATIONS

H. T. Tsang et al., Effects of Volume Fraction of Reinforcement on Tensile and Creep Properties of In–Situ TiB/Ti MMC, Scripta Materiala, vol. 37, No. 9, Nov. 1997, pp. 1359–1365.

* cited by examiner

*Primary Examiner*—Daniel J. Jenkins
(74) *Attorney, Agent, or Firm*—Oliff & Berridge, PLC

(57) ABSTRACT

A process for producing a particle-reinforced titanium alloy includes the steps of: heating a titanium alloy in which ceramic particles having a thermodynamically stable property are dispersed in a temperature range of not less than β-transus temperature; and cooling the titanium alloy to pass through the β-transus temperature at a cooling rate of 0.1–30° C./second. The process can further include, before the heating step, the step of compressing the titanium alloy in a two phase temperature range of α+β thereof or in a temperature range of not less than β-transus temperature.

17 Claims, 2 Drawing Sheets

PROCESS FOR PRODUCING PARTICLE-REINFORCED TITANIUM ALLOY

BACKGROUND OF THE INVENTION

1. Field of the Invention

The present invention relates to a process for producing a particle-reinforced titanium alloy which is reinforced by ceramic particles having a thermodynamically stable property in titanium alloy.

2. Description of the Related Art

There has been known particle-reinforced titanium alloy which is reinforced by particles. As a technique for producing this type titanium alloy, Japanese Unexamined Patent Publication 10-1,760 has been provided. This Patent Publication technique includes: (1) using titanium alloy which is reinforced by dispersing ceramic particles having a thermodynamically stable property, such as titanium boride, in a matrix, and (2) heat-treating this titanium alloy to dissolve a colony grain structure and to generate a minute-acicular α phase structure. According to the process disclosed in this publication, the above-mentioned particle-reinforced titanium alloy is produced by way of the steps including: (1) heating the titanium alloy in a temperature range not less than β-transus temperature; (2) quenching the titanium alloy with water from the temperatures range not less than β-transus temperature to room temperature or to under room temperature; and (3) heating the titanium alloy in a two phase region of (α+β) formed between β-transus temperature and 800° C. The quenching step indicates a considerably rapid cooling rate.

Also, Japanese Unexamined Patent Publication 3-73,623 discloses another process for heat-treating a α+β type titanium alloy. This process includes: (1) heating the titanium alloy having a α+β type in a temperature range which is 10–60° C. lower than β-transus temperature; and (2) cooling the titanium alloy at a cooling rate of 0.1–5° C./second to less than 500° C. so as to improve toughness thereof. When heating temperature is not less than β-transus temperature, a phase of β easily becomes a large-size. In this publication technique, it is guessed that heating temperature is set at temperatures which is 10–60° C. lower than β-transus temperature for avoiding a large-sized phase of β.

SUMMARY OF THE INVENTION

The technique disclosed in Japanese Unexamined Patent Publication 10-1,760 intends to improve fatigue strength of titanium alloy; however, it does not intend to improve creep resistance. When the heat treatment disclosed in this publication is carried out, acicular α phases are parted and then change into broken-up structures; therefore, creep property is deteriorated in spite of high fatigue strength. Generally, it is thought that a finer microstructure leads to improved fatigue strength and that a larger microstructure leads to suppressed creep deflection and improved creep resistance.

Also, the technique disclosed in Japanese Unexamined Patent Publication 3-73,623 intends to improve toughness; however, it does not intend to improve creep resistance. Further, the titanium alloy disclosed in this publication does not contain particles such as titanium boride particles, and heating temperature does not exceed β-transus temperature.

The present invention has been accomplished in view of the aforementioned circumstances. It is therefore an object of the present invention to provide a process for producing particle-reinforced titanium alloy which is excellent in creep resistance while ensuring fatigue strength.

The present inventors have eagerly researched titanium alloy and have developed the present invention by experimentally confirming the following phenomenon. When the present inventors have carried out: using titanium alloy in which ceramic particles are dispersed having a thermodynamically stable property; heating the titanium alloy in a temperature range of not less than β-transus temperature; and cooling the titanium alloy at a cooling rate of 0.1–30° C./second: titanium alloy is improved in creep resistance while ensuring fatigue strength.

The reason for obtaining the above-mentioned characteristics is not surely clear. However, this reason is guessed as follows:

It is thought that a larger microstructure contributes to suppress creep deflection and to improve creep resistance, and that a finer microstructure contributes to improve fatigue strength. The present invention uses the titanium alloy in which ceramic particles having a thermodynamically stable property are dispersed. Therefore, the present invention prevents abnormal growth of the old of β grain, in spite of the complete acicular formation of microstructures, even when the titanium alloy is heated in a temperature range of not less than β-transus temperature. Also, since the titanium alloy is cooled from the range of not less than β-transus temperature, and since the titanium alloy passes through β-transus temperature at an appropriate cooling rate of 0.1–30° C./second, the microstructure size of titanium alloy is appropriate in such a manner that both creep resistance and fatigue strength are ensured.

The present invention provides a process for producing a particle-reinforced titanium alloy, which comprises the steps of: heating a titanium alloy in which ceramic particles having a thermodynamically stable property are dispersed in a temperature range of not less than β-transus temperature; and cooling the heated titanium alloy to pass through the β-transus temperature at a cooling rate of 0.1–30° C./second.

The present invention can provide a particle-reinforced titanium alloy in which creep resistance is excellent while fatigue strength is ensured.

PREFERABLE MODE OF THE PRESENT INVENTION

The present invention employs titanium alloy in which ceramic particles having thermodynamically stable property are dispersed.

The titanium alloy may be a sintered compact formed by sintering a green compact, a forged product formed by forging the sintered compact, a cast product, or a forged product formed by forging the cast product. As for forging, hot forging can be used.

The titanium alloy can include an α phase-stabilizing element, for example aluminum (Al), and a β phase-stabilizing element. The titanium alloy can contain, at least, 3–6% of aluminum (Al), and 2–6% of tin (Sn) by weight, when a matrix of titanium alloy is 100% by weight. However, the present invention process is not limited within these contents.

The microstructure of matrix of the titanium alloy in an ordinary-temperature region may be a microstructure wholly formed of α phases, a microstructure mainly formed of α phases, or a microstructure formed of α phases being mixed with β phases. The α phase may be an acicular α phase, or an acicular α phase mixed with an equi-axed α phase.

The ceramic particles having a thermodynamically stable property may be titanium boride (TiB and $TiB_2$), titanium carbide (TiC and $TiC_2$), titanium silicide, and titanium nitride (TiN). In particular, titanium boride is preferable in such ceramic particles. Titanium boride can work as a hard particle or a reinforcing particle in a matrix of titanium alloy. Titanium boride has good congeniality for the matrix of titanium alloy; so, it is suppressed that a weak reactive phase for causing fatigue crack is formed in an interface between the titanium boride and the matrix of the titanium alloy.

Proportion of the ceramic particles having a thermodynamically stable property, such as titanium boride, can be chosen depending on applications, etc. An upper limit of the proportion may be 10% or 7% by volume, and a lower limit may be 0.1% or 0.4% by volume, in the case where the whole titanium alloy with ceramic particles dispersed therein is 100% by volume. However, the proportion of the ceramic particle is not limited within these ranges.

An average particle size of ceramic particles having a thermodynamically stable property, such as titanium boride, can be chosen depending on applications, etc. For example, an upper limit of the average particle size of the ceramic particle may be 50 $\mu$m. A lower limit of the average particle size of the ceramic particle may be 0.5 $\mu$m. However, the average particle size of the ceramic particle is not limited within this range.

The present invention includes the step of heating the titanium alloy in which ceramic particles having a thermodynamically stable property (e.g. titanium boride) are dispersed in a temperature range of not less than β-transus temperature. The old β grain is produced by such step. Means of this heating step may be induction heating, furnace heating, or other heating modes. Heating time can be chosen depending on heating conditions of induction heating or furnace heating, size of titanium alloy, etc. Since the ceramic particles having a thermodynamically stable property are dispersed in the titanium alloy, the present invention can prevent the size of the old β grain from excessively increasing, even when the size of the old β grain is to be excessively increased because of a long heating time.

The present invention includes the step of cooling the titanium alloy, in which the ceramic particles having a thermodynamically stable property are dispersed, from a temperature range of not less than β-transus temperature at a cooling rate of 0.1–30° C./second. Therefore, the titanium alloy is cooled to pass through β-transus temperature at a cooling rate of 0.1–30° C./second. The cooling rate of 0.1–30° C./second is obtained generally by gas cooling, and it is considerably slower than that of quenching. A representative cooling mode may be a gas cooling mode utilizing rare gas as cold gas, and an air cooling mode.

According to the present invention, there can be obtained an appropriate matrix, and an appropriate size of the microstructure of titanium alloy with the ceramic particles such as titanium boride having a thermodynamically stable property dispersed therein.

A preferable mode of the present invention further includes the step of compressing the titanium alloy before such heating step. The compressing step is, for example, a step of forging the titanium alloy. In the compressing step, the titanium alloy, in which the ceramic particles having a thermodynamically stable property such as titanium boride are dispersed, is compressed in a two phase temperature range of α+β or in a temperature range of not less than β-transus temperature.

That is to say, the heating step is carried out after the titanium alloy is compressed—for example, by forging. The compressing step is carried out in the case where the matrix of titanium alloy is formed of a mixed phase of α+β or a phase of β. Density of the titanium alloy can be made advantageously higher by compressing the titanium alloy. Therefore, pores can be advantageously reduced in the case where the titanium alloy is formed by powder metallurgy.

The present invention includes the step of cooling the titanium alloy from the temperature range of not less than β-transus temperature at a cooling rate of 0.1–30° C./second. As mentioned above, this cooling rate is much slower than that of quenching. The cooling rate of 0.1–30° C./second can improve creep resistance. Therefore, the present invention is suitable in producing high strength parts to be used in high-temperature atmosphere, such as valves of internal combustion engines, etc.

Moreover, it is preferable that titanium alloy has an elongation value over the predetermined value so as to ensure impact resistance of the titanium alloy. When the cooling rate is less than 0.1° C./second, the elongation value is small, as shown in FIG. 2, and impact resistance is disadvantageous. The above-mentioned cooling rate is preferable in ensuring elongation and impact resistance. Accordingly, the present invention is suitable in producing high temperature strength parts formed of the titanium alloy, such as valves of internal combustion engines.

The induction heating can be used in heating the above-mentioned titanium alloy in a temperature range of not less than β-transus temperature. In particular, high frequency induction heating is preferable. The induction heating can shorten heating time of titanium alloy and can improve cycle time of productivity. In addition, the induction heating effectively reduces an exposing time in which the titanium alloy is exposed to a high-temperature atmosphere to suppress surface oxidation of the titanium alloy and to advantageously reduce a machining margin of the titanium alloy.

DETAILED DESCRIPTION OF THE PREFERRED EMBODIMENTS

Figure 1:
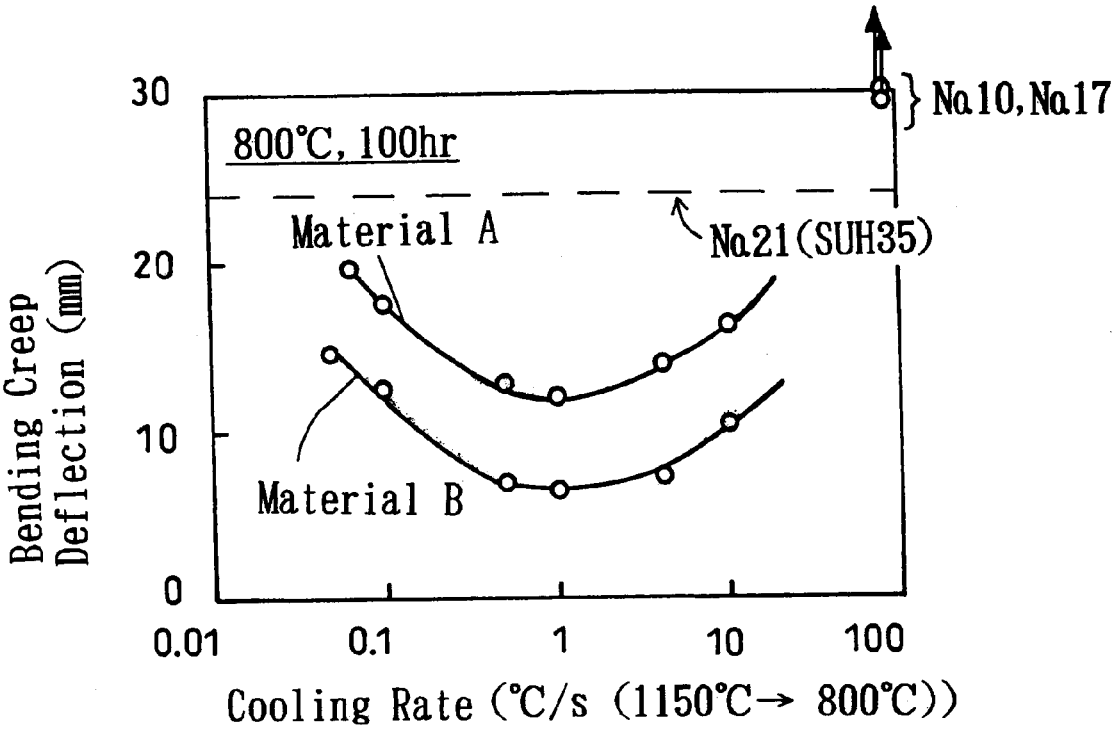
FIG. 1 shows a graph which shows a relationship between a cooling rate and a bending creep deflection, wherein the cooling rate is a speed from 1,150° C., a temperature not less than β-transus temperature, to 800° C.

The present invention will be hereinafter explained with comparative examples. The present inventors prepared base powders of: (1) a hydride-dehydride titanium powder having a smaller particle size than 150 $\mu$m which is formed by dehydrogenation of titanium hydride; (2) an aluminum alloy powder having an average particle size of 10 $\mu$m; and (3) a titanium boride powder ($TiB_2$) having an average particle size of 4 $\mu$m. Composition of the aluminum alloy powder was the Al—Sn—Zr—Nb—Mo—Si alloy.

These base powders to form samples were weighed at predetermined rates to show matrix compositions described in Table 1. That is to say, when the whole titanium alloy including titanium boride was 100% by volume, as for proportion of titanium boride, sample No.1 was 1% by volume, sample No.2 was 3% by volume, and samples No.3–No.18 were 5% by volume, respectively. However, samples No.19, No.20, No.22 and No.23, exhibiting comparative examples, contained 0% titanium boride, respectively. Sample No.21, exhibiting a comparative example, was formed of a cast product produced by JIS-SUH alloy showing Fe—Cr—Mn—Ni system.

After weighing, the base powders were uniformly mixed to become a mixed powder. This mixed powder was compacted by a metallic die to produce a compact product which was a cylindrical-shaped billet. The billet had a diameter of 16 mm, and a height of 32 mm. Compressing pressure was set at 5 tonf/cm$^2$. Next, this billet was heated for sintering in a high vacuum atmosphere ($1\times10^{-5}$ Torr) at 1300° C. for 4 hours to form a sintered body. In addition, this sintered compact was heated at 1100° C. Then, this sintered compact was pushed by extruding equipment to form an extruded product having a stem portion. Afterwards, the extruded product was upset-forged to form an umbrella portion. The upset-forging was carried out when the titanium alloy was in a two phase temperature range of ($\alpha+\beta$), or in a temperature range of not less than β-transus temperature. Therefore, a forged body was formed having the axial shaped stem portion and the umbrella portion connected with an end portion of the stem portion. This forged body is to be used as a valve for internal combustion engines such as vehicles.

This forged body was heated for about 20 minutes by a heating furnace at 1150° C., which is not less than β-transus temperature. The heating means was a vacuum furnace capable of receiving a cooling gas (rare gas, for example, argon gas) when the sample was cooled by gas. A furnace was used when the sample was cooled by air. After heating, a cooling rate down to 800° C. was controlled at various conditions shown in Table 1 to produce a heat-treated body concerning each sample. In the case of gas cooling, the cooling rate was obtained by controlling the supply of cooling gas to the heating furnace—the cooling gas was a rare gas such as argon gas.

As for samples No.6 and No.11 exhibiting comparative examples, a cooling rate was 0.05° C./s, and it was slower than that of the present invention. As for samples No.10 and No.17 which were water-cooled, exhibiting comparative examples, a cooling rate was 100° C./s, and it was faster than that of the present invention.

Also, after forging, sample No.18 was heated by high frequency induction heating at 1160° C., namely, a temperature of not less than β-transus temperature. Then, sample No.18 was cooled in air. The air cooling shows a cooling rate of 4–5° C./second, exhibiting a cooling rate of the present invention.

The test pieces were collected from each sample after heating, respectively. The test pieces were subjected to a high-temperature bending creep test about creep deflection for carrying out creep test quickly and simply. The test temperature was 800° C., and the largest bending stress was 51 MPa. Also, other test pieces for fatigue test were collected from each sample after heating, respectively. The test pieces for fatigue test, having a parallel portion length of 10 mm and a parallel portion diameter of 4 mm, were subjected to a fatigue test (test temperature: 850° C.). In addition, the test pieces for tensile test were collected from each sample after heating. The test pieces for tensile test, having a parallel portion length of 10 mm and a parallel portion diameter of 4 mm, were subjected to a tensile test for measuring room temperature elongation.

Table 1 shows matrix compositions of titanium alloy, a proportion of titanium boride particles in titanium alloy, conditions for heating titanium alloy in a temperature range of not less than β-transus temperature, and a cooling rate of from 1,150° C., the temperature range of not less than β-transus temperature, to 800° C.

According to Table 1, as for sample No.1, when the whole titanium alloy having titanium boride was set at 100% by volume, titanium boride was 1% by volume, and a matrix of the titanium alloy was 99% by volume. Then, when the whole matrix of this titanium alloy was set at 100% by weight, the matrix contained 5.75% aluminum (Al) by weight, 3.92% tin (Sn) by weight, and 3.92% zirconium (Zr) by weight, etc.

Evaluation

Table 1 shows the test results on creep deflection, fatigue strength (850° C.), room temperature elongation. As understood from Table 1, as for the samples concerning the present invention, creep deflection was small and creep resistance was good. Moreover, as for the samples concerning the present invention, fatigue strength satisfactorily exceeded 100 MPa, room temperature elongation satisfactorily exceeded 1%, and impact resistance was good.

TABLE 1

| | Sample No. | Matrix Composition of Titanium Alloy weight % Al | Sn | Zr | Nb | Mo | Si | oxygen | Titanium Boride volume % | Condition of heating step | Cooling Rate ° C./s | Creep Deflection 100 hr, mm | 850° C. MPa Fatigue Strength | Room Temperature Elongation % | Invention ○ |
|---|---|---|---|---|---|---|---|---|---|---|---|---|---|---|---|
| Material A | 1 | 5.75 | 3.92 | 3.92 | 1.03 | 0.99 | 0.14 | 0.36 | 1 | 1150° C., 20 min | 1 | 12.5 | 140 | 4.8 | ○ |
| | 2 | 5.71 | 3.91 | 3.90 | 1.03 | 0.98 | 0.14 | 0.37 | 3 | ↑ | 1 | 15.0 | 150 | 4.4 | ○ |
| | 3 | 6.31 | 4.30 | 4.31 | 1.13 | 1.08 | 0.16 | 0.31 | 5 | ↑ | 1 | 7.0 | 180 | 2.1 | ○ |
| | 4 | 5.97 | 4.20 | 4.04 | 1.07 | 1.02 | 0.15 | 0.30 | 5 | ↑ | 1 | 10.0 | 150 | 3.4 | ○ |
| | 5 | 5.38 | 3.89 | 3.63 | 0.96 | 0.91 | 0.13 | 0.37 | 5 | ↑ | 1 | 19.0 | — | 5.2 | ○ |
| | 6 | 5.83 | 3.99 | 3.92 | 1.05 | 1.00 | 0.22 | 0.36 | 5 | ↑ | 0.05 | 20.0 | — | — | Comparative |
| | 7 | ↑ | ↑ | ↑ | ↑ | ↑ | ↑ | ↑ | ↑ | ↑ | 1 | 10.0 | 150 | — | ○ |
| | 8 | ↑ | ↑ | ↑ | ↑ | ↑ | ↑ | ↑ | ↑ | ↑ | 4 | 12.5 | — | — | ○ |
| | 9 | ↑ | ↑ | ↑ | ↑ | ↑ | ↑ | ↑ | ↑ | ↑ | 10 | 16.0 | — | — | ○ |
| | 10 | ↑ | ↑ | ↑ | ↑ | ↑ | ↑ | ↑ | ↑ | ↑ | Water | >30.0 | — | — | Comparative |

TABLE 1-continued

| Sample No. | Matrix Composition of Titanium Alloy weight % Al | Sn | Zr | Nb | Mo | Si | oxygen | Titanium Boride volume % | Condition of heating step | Cooling Rate ° C./s | Creep Deflection 100 hr, mm | 850° C. MPa Fatigue Strength | Room Temperature Elongation % | Invention ○ |
|---|---|---|---|---|---|---|---|---|---|---|---|---|---|---|
| B | | | | | | | | | | | | | | |
| 11 | 6.11 | 4.00 | 4.00 | 0.99 | 1.03 | 0.14 | 0.35 | 5 | ↑ | 0.05 | 14.0 | 130 | 1.0 | Comparative |
| 12 | ↑ | ↑ | ↑ | ↑ | ↑ | ↑ | ↑ | ↑ | ↑ | 0.1 | 12.0 | 150 | 1.7 | ○ |
| 13 | ↑ | ↑ | ↑ | ↑ | ↑ | ↑ | ↑ | ↑ | ↑ | 0.5 | 7.0 | — | — | ○ |
| 14 | ↑ | ↑ | ↑ | ↑ | ↑ | ↑ | ↑ | ↑ | ↑ | 1 | 7.0 | 170 | 2.0 | ○ |
| 15 | ↑ | ↑ | ↑ | ↑ | ↑ | ↑ | ↑ | ↑ | ↑ | 4 | 7.5 | — | 2.3 | ○ |
| 16 | ↑ | ↑ | ↑ | ↑ | ↑ | ↑ | ↑ | ↑ | ↑ | 10 | 10.5 | 150 | — | ○ |
| 17 | ↑ | ↑ | ↑ | ↑ | ↑ | ↑ | ↑ | ↑ | ↑ | Water | >30.0 | — | — | Comparative |
| 18 | ↑ | ↑ | ↑ | ↑ | ↑ | ↑ | ↑ | ↑ | 1160° C., 2 min High Frequency Induction Heating | Air Cooling | 7.5 | — | — | ○ |
| 19 | 6.00 | 2.75 | 4.00 | — | 0.40 | 0.45 | 0.07 | 0 | 1005° C., 2.5 hr 650° C., 8 hr | Air Cooling | >30.0 | 130 | 3.3 | Comparative |
| 20 | ↑ | ↑ | ↑ | — | ↑ | ↑ | ↑ | ↑ | 1090° C., 30 min 590° C., 8 hr | Air Cooling | 6.0 | 100 | 2.0 | Comparative |
| 21 | SUH35: Fe—2.09Cr—9.0Mn—3.8Ni—0.12Nb (0.48C—0.37N—0.1Mo—0.1V—0.1W) | | | | | | | | — | — | 24.0 | 150 | 15.0 | Comparative |
| 22 | 5.74 | 3.92 | 3.91 | 1.03 | 0.99 | 0.14 | 0.32 | 0 | 920° C., 2 hr | Air | >30.0 | 140 | 5.0 | Comparative |
| 23 | ↑ | ↑ | ↑ | ↑ | ↑ | ↑ | ↑ | ↑ | 1150° C., 20 min | 1 | 7.0 | 110 | 1.0 | Comparative |

That is to say, as for the samples concerning the present invention, fatigue strength and elongation was good as well as creep resistance. Therefore, the samples concerning the present invention were suitable as valve material to be used for internal combustion engines of vehicles, etc. This valve material may be intake air valve material and exhaust valve material. Here, sample No.5 concerning the present invention intends to improve elongation, while ensuring creep resistance.

Material A

As understood from Table 1, samples No.6–No.10 had the same composition, formed of material A. Samples No.6–No.10 were different in a cooling rate, although they were the same in matrix composition, titanium boride content, and heating condition—the titanium boride content was 5% by volume, the heating temperature was 1150° C., which is not less than β-transus temperature.

In particular, as for sample No.6 showing the comparative example, titanium boride was contained 5% by volume, titanium alloy was heated over β-transus temperature, the cooling rate was too slow; therefore, creep deflection was as large as 20.0 mm, and creep resistance was deteriorated. Further, as for sample No.10 showing the comparative example, titanium boride was contained 5% by volume, the titanium alloy was heated over β-transus temperature, the cooling rate was too fast since the titanium alloy was cooled by water; therefore, creep deflection was as large as 30.0 mm, and creep resistance was deteriorated.

However, as understood from Table 1, as for sample No.7, No.8, and No.9 showing the present invention, creep deflection was small, and creep resistance was improved. Further, as for sample No.7 showing the present invention, fatigue strength was also good.

Material B

As understood from Table 1, samples No.11–No.17 had the same composition, formed of material B. Samples No.11–No.17 were different in a cooling rate, although they were the same in titanium boride content and heating conditions—a titanium boride content was 5% by volume, a heating temperature was 1150° C., which is not less than β-transus temperature.

As for sample No.11 concerning the comparative example, titanium boride was contained 5% by volume, titanium alloy was heated over β-transus temperature, the cooling rate was much slower. So, although creep deflection was more than 14.0 mm to be good, elongation was as small as 1.0%.

Further, as for sample No.17 concerning the comparative example, titanium boride was contained 5% by volume, titanium alloy was heated over β-transus temperature, and the cooling rate was much faster because of water-cooling; therefore, creep deflection was more than 30.0 mm to be large, and creep resistance was deteriorated.

On the other hand, as for samples No.12, No.13, No.14, No.15, and No.16 concerning the present invention, creep deflection was small, creep resistance was good, fatigue strength was also good, and elongation satisfactorily exceeded 1.0% to be good.

As for sample No.18 concerning the present invention, titanium alloy was heated in the temperature range of not less than β-transus temperature by high frequency induction heating. In this case, creep resistance was good, although heating time was as short as 2 minutes. In addition, heating time was sufficient in a short time, 2 minutes, because of high frequency induction heating capable of rapid heating. Therefore, oxidized layer can be reduced on a surface of the titanium alloy, and a machining cost after the heat treatment can be reduced.

OTHER PRACTICAL EXAMPLES

As for No.19 concerning the comparative example, titanium alloy having no titanium boride was used. The titanium alloy was heated for 2 hours at 1005° C., namely, in a temperature range of α+β phase and being less than β-transus temperature. After heating, the titanium alloy of No.19 was quenched with water. Next, the titanium alloy of No.19 was heated at 650° C. for 8 hours for tempering. Afterwards, the titanium alloy of No.19 was cooled by air. As for No.19 concerning the comparative example, creep deflection was as large as over 30.0 mm, and the creep resistance was deteriorated, although fatigue strength and elongation were ensured.

As for No.20 concerning the comparative example, titanium alloy having no titanium boride was heated at 1090° C. for 30 minutes, namely, it was heated over β-transus temperature. After heating, titanium alloy of No.20 was quenched with water. Next, it was heated at 590° C. for 8 hours for tempering and it was cooled by air. As for titanium alloy of No.20 concerning the comparative example, although creep deflection was 6.0 mm, and creep resistance was good, fatigue strength was not sufficient.

Since No.21 concerning the comparative example was formed by a ferrous cast product, made of JIS-SUH 35 being used as valve material in a conventional technique, which was different from the present invention in material. As for No.21 concerning the comparative example, creep deflection was 24.0 mm. Therefore, the titanium alloy of the present invention was better than No.21 of the comparative example in creep resistance. As for No.22 of the comparative example, titanium boride was not included, heating temperature was 920° C., under β-transus temperature. Therefore, as for No.22, creep deflection was as large as over 30.0 mm, and creep resistance was deteriorated, although fatigue strength was good.

As for sample No.23 of the comparative example, the titanium alloy was heated over β-transus temperature, and the cooling rate was suitable. However, sample No.23 contained no titanium boride. As for sample No.23 of the comparative example, creep deflection was 7.0 mm to be good. The reason why creep resistance becomes good is that the size of β phase is larger when the titanium alloy is heated over β-transus temperature. However, as for sample No.23, fatigue strength was 110 MPa to be insufficient, and elongation was as small as 1.0%. Therefore, sample No.23 was not suitable as valve material for the internal combustion engines. The reason for insufficient fatigue strength and elongation probably is that sample No.23 has no titanium boride.

Graph

FIG. 1 shows a relationship between a cooling rate, from 1150° C., corresponding to a temperature of not less than β-transus temperature, to 800° C., and a bending creep deflection (at 800° C., for 100 hours). As understood in FIG. 1, when the cooling rate was less than 0.1° C./s, creep deflection increased, and creep resistance was deteriorated. Also, when the cooling rate was over 30° C./s, creep deflection was increased, and creep resistance was deteriorated. In other words, the cooling rate of 0.1–30° C./s indicated a minimum region of creep deflection to obtain a good creep resistance. Judging from test results of FIG. 1, a cooling rate of 0.5–10° C./second was preferable.

As shown in FIG. 1, bending creep deflection of the present invention was smaller than that of sample No.21 (JIS-SUH35) of the comparative example, and those of No.10 and No.17 corresponding water-cooled samples.

Figure 2:
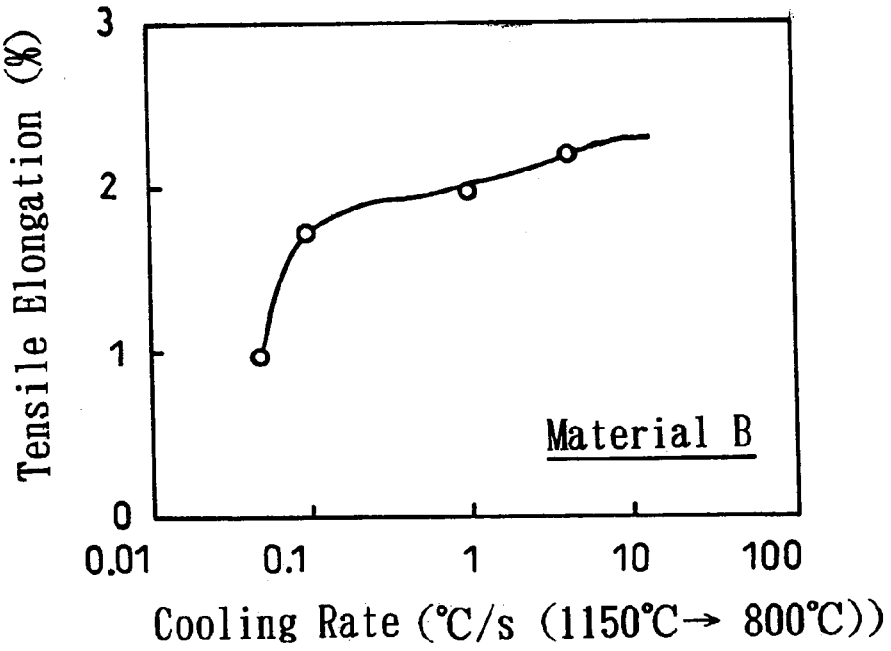
FIG. 2 shows a graph which shows a relationship between a cooling rate and tensile elongation at room temperature, wherein the cooling rate is a speed from 1,150° C., a temperature not less than β-transus temperature, to 800° C.

Also, FIG. 2 shows a relationship between a cooling rate from 1,150° C. corresponding to a temperature not less than β-transus temperature, to 800° C., and tensile elongation. As understood in FIG. 2, when the cooling rate was less than 0.1° C./s, the room temperature elongation was insufficiently small, and it is not enough in impact resistance. However, in the cooling rate of 0.1–30° C./s, good elongation was obtained, resulting in good impact resistance; so, the titanium alloy of the present invention was more suitable as valve material of internal combustion engines.

APPLICATION EXAMPLE

Figure 3:
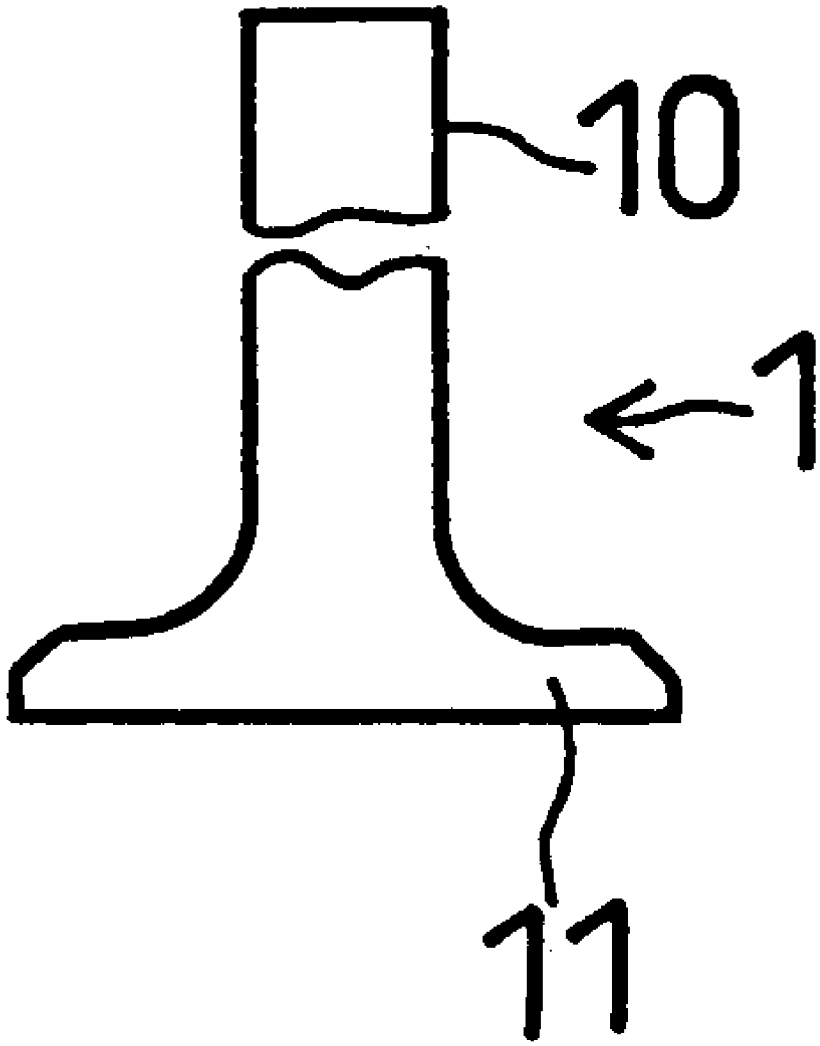
FIG. 3 shows a construction drawing of an application example.

FIG. 3 shows one of application examples. The present example has a valve 1 produced based on the above-mentioned sample concerning the present invention, and the valve 1 is formed of titanium alloy including titanium boride particles. The valve 1 is to be used for internal combustion engines. The valve 1 has a stem portion 10 and an umbrella portion 11 connected to an edge of the stem portion 10.

Titanium alloy concerning the present invention can be applied to heat resistance parts such as turbine blades besides the above-mentioned valve.

What is claimed is:

1. A process for producing a particle-reinforced titanium alloy, which comprises the steps of:

heating a titanium alloy in which ceramic particles having a thermodynamically stable property are dispersed in a temperature range of not less than β-transus temperature; and cooling said heated titanium alloy to pass through the β-transus temperature at a cooling rate of 0.1–30° C./second.

2. The process for producing a particle-reinforced titanium alloy according to claim 1, which further comprises, before said heating step, the step of:

compressing said titanium alloy in a two phase temperature range of α+β phase or in a temperature range of not less than β-transus temperature.

3. The process for producing a particle-reinforced titanium alloy according to claim 1, wherein said ceramic particles are formed of at least one selected from the group consisting of titanium boride, titanium carbide, titanium silicide, and titanium nitride.

4. The process for producing a particle-reinforced titanium alloy according to claim 3, wherein said titanium boride is formed of at least one of TiB and $TiB_2$, and said titanium carbide is formed of at least one of TiC and $TiC_2$.

5. The process for producing a particle-reinforced titanium alloy according to claim 1, wherein said ceramic particles are included in a range from 0.1 to 10% by volume, when the whole titanium alloy is 100% by volume.

6. The process for producing a particle-reinforced titanium alloy according to claim 1, wherein said ceramic particles are included in a range from 0.4 to 7% by volume, when the whole titanium alloy is 100% by volume.

7. The process for producing a particle-reinforced titanium alloy according to claim 1, wherein an average particle size of said ceramic particle is in a range from 0.5 to 50 μm.

8. The process for producing a particle-reinforced titanium alloy according to claim 1, wherein said titanium alloy is one selected from the group consisting of a forged product, a sintered body formed by sintering a green compact, a forged product formed by forging said sintered body, a cast product, or a forged product formed by forging said cast product.

9. The process for producing a particle-reinforced titanium alloy according to claim 1, wherein said titanium alloy includes an a phase-stabilizing element, and a β phase-stabilizing element.

10. The process for producing a particle-reinforced titanium alloy according to claim 1, wherein said titanium alloy contains at least 3–7% of aluminum (Al) by weight, and 2–6% of tin (Sn) by weight, when a matrix of the titanium alloy is 100% by weight.

11. The process for producing a particle-reinforced titanium alloy according to claim 1, wherein said titanium alloy contains at least 3–7% of aluminum (Al) by weight, 2–6% of tin (Sn) by weight, 2–6% of zirconium (Zr) by weight, 0.8–1.5% of niobium (Nb) by weight, 0.7–1.5% of molybdenum (Mo) by weight, and 0.05–0.4% of silicon (Si) by weight, when a matrix of the titanium alloy is 100% by weight.

12. The process for producing a particle-reinforced titanium alloy according to claim 1, wherein said heating step is carried out by induction heating or by furnace heating.

13. The process for producing a particle-reinforced titanium alloy according to claim 1, wherein said cooling rate is in a range of 0.5–5° C./second.

14. The process for producing a particle-reinforced titanium alloy according to claim 1, wherein said cooling step is carried out by gas cooling including air cooling.

15. The process for producing a particle-reinforced titanium alloy according to claim 1, wherein said particle-reinforced titanium alloy is formed into high temperature strength parts.

16. The process for producing a particle-reinforced titanium alloy according to claim 1, wherein said particle-reinforced titanium alloy is formed into a valve of internal combustion engines, said valve having a stem portion extending in an axial direction and an umbrella portion connected with an end portion of said stem portion.

17. The process for producing a particle-reinforced titanium alloy according to claim 1, wherein said titanium alloy is formed of base powders of: (1) a hydride-dehydride titanium powder which is formed by dehydrogenation of titanium hydride; (2) an aluminum alloy powder; and (3) a titanium boride powder.

* * * * *